United States Patent [19]

Lewandowski

[11] Patent Number: 4,736,848

[45] Date of Patent: Apr. 12, 1988

[54] STOPCOCK PACKAGE

[75] Inventor: Raymond Lewandowski, New Providence, N.J.

[73] Assignee: Becton, Dickinson and Company, Franklin Lakes, N.J.

[21] Appl. No.: 373,941

[22] Filed: May 3, 1982

[51] Int. Cl.[4] ..... B65D 73/00

[52] U.S. Cl. ..... 206/471; 206/45.33

[58] Field of Search ..... 206/45.33, 461, 471, 206/466, 493, 495, 497, 531, 590, 45.14, 305, 465, 485, 493

[56] References Cited

U.S. PATENT DOCUMENTS

| | | | |
|---|---|---|---|
| 3,365,056 | 1/1968 | Mandel | 206/45.33 |
| 3,365,308 | 1/1968 | Janiche | 206/45.33 |
| 3,403,869 | 10/1968 | Marchisen et al. | 206/461 X |
| 3,406,686 | 10/1968 | Ueller | 206/471 |
| 3,530,981 | 9/1970 | Wieneche, Jr. | 206/310 |
| 3,630,346 | 12/1971 | Burnside | 206/461 X |
| 3,809,221 | 5/1974 | Compere | 206/531 |
| 3,972,417 | 8/1976 | Iten et al. | 206/493 X |

*Primary Examiner*—Stephen Marcus
*Assistant Examiner*—B. Gehman
*Attorney, Agent, or Firm*—John L. Voellmicke

[57] ABSTRACT

A package for sealing an article, such as a stopcock, therein includes a substantially rigid receptacle for receipt of the article. There is an open end on said package sufficiently large for access of the article into and out of the receptacle. A retention portion of said receptacle is adapted to prevent rotatory movement of the article therein. A tapered closed end portion of the receptacle receives a part of the article. The open end is adapted to be sealed with a cover after an article is placed inside the receptacle.

9 Claims, 4 Drawing Sheets

STOPCOCK PACKAGE

BACKGROUND OF THE INVENTION

1. Field of the Invention

The present invention relates to a package for sealing an article therein, and more particularly, concerns a package for sealing a stopcock therein and also relates to a packaged stopcock assembly.

2. Description of the Prior Art

Articles such as stopcocks used for medicinal or health related applications are normally packaged in a sterile or clean container. These stopcocks are used, for example, in conjunction with a syringe or like instrument for the simultaneous handling of more than one fluid. For instance, a hospital pharmacist may need to prefill a syringe with fluid; a stopcock with three or four ports would be used so that fluid can be transferred from a source to the syringe to be filled with a minimal number of steps. Such a procedure using a stopcock not only minimizes manipulative steps, but also contributes to reducing the opportunities for contamination. Most three or four-way stopcocks which are on the market today, and which are sterile and disposable for health or medicinal purposes, are packaged individually in blister-type packages. These blister-type packages often are very flexible and include a cover which is peeled from the package when the stopcock is to be used. When inside these packages, the stopcocks are not held in any fixed position, so that when the cover is peeled from the package, the user can empty the stopcock from the package by merely turning the package over. Of course, once the stopcock falls out of the package, it may become contaminated on the surface upon which it falls. Furthermore, if the user chooses, instead of emptying the stopcock from the package, to attach the syringe to the stopcock while it is still in the package, oftentimes finger manipulation is required to correctly orient the stopcock for attachment. Once again, this manipulation provides greater opportunities for risk of contamination.

With the following deficiencies in mind, it has been desired to provide a stopcock (or similar article) package which will serve to orient the stopcock in the proper position so that it can be attached to a syringe, or like device, before it is removed from the package. The present invention is directed to satisfying this desired need for such a stopcock package.

SUMMARY OF THE INVENTION

The package of the present invention for sealing an article therein comprises a substantially rigid receptacle for receipt of the article. This receptacle has an open end sufficiently large for access of the article into and out of the receptacle. A retention portion of the receptacle is adapted to prevent rotatory movement of the article therein. A tapered closed end portion of the receptacle receives part of the article therein. The open end of the receptacle is adapted to be sealed with cover means after an article is placed inside.

In a preferred embodiment of the present invention, the article to be enclosed in the package is a stopcock, having at least three ports. The receptacle is defined by at least three orthogonally oriented sidewalls forming a retention portion for the stopcock and for preventing rotatory movement of the stopcock therein. A portion of these sidewalls is tapered toward each other to form a closed end of the receptacle. It is preferred that opposed orthogonal walls include detents for maintaining the stopcock in position within the receptacle.

In another aspect of the present invention, a packaged stopcock assembly includes the stopcock positioned inside a package substantially as described above, and further including removable cover means sealing the open end of the package.

In accordance with the principles of the present invention, the rigid receptacle allows the stopcock, or other article, to be packaged, shipped, and stored under relatively protective circumstances. The stopcock is preferably oriented in this package so that, once the cover is peeled therefrom, a syringe or like evice can be readily and immediately connected to one port of the stopcock. This connection can be achieved while the stopcock remains positioned inside the package after the cover is removed; the user's hands need not touch the stopcock since te package will be held on the outside while the syringe is being connected. Inasmuch as the stopcock is maintained in this package with minimal or no ability to be rotated, connection to a syringe by a screw-type procedure is most compatible with this invention. Thus, the present invention relies upon minimal manipulation of the stopcock for its subsequent attachment to a syringe, while at the same time minimizing the risks of contamination once the cover is removed from the package.

DETAILED DESCRIPTION

Figure 1:
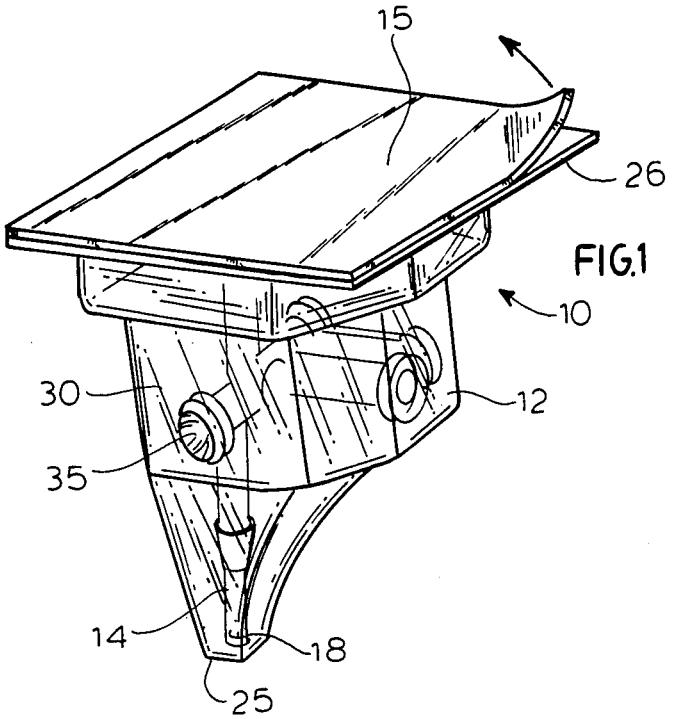
FIG. 1 is a perspective view of the preferred packaged stopcock assembly of the present invention.

While this invention is satisfied by embodiments in many different forms, there is shown in the drawings and will herein be described in detail a preferred embodiment of the invention with the understanding that the present disclosure is to be considered as exemplary of the principles of the invention and is not intended to limit the invention to the embodiment illustrated. The scope of the invention will be measured by the appended claims and their equivalents.

Figure 2:
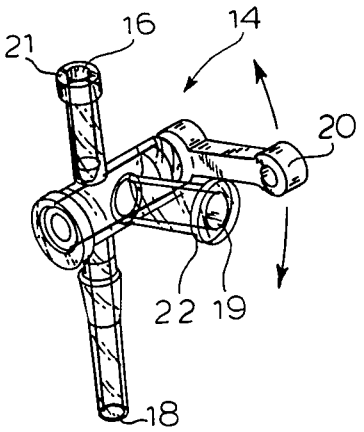
FIG. 2 is a perspective view of a three-way stopcock which is packaged in the assembly of FIG. 1.

Adverting to the drawings, and FIG. 1 in particular, there is illustrated a packaged stopcock assembly 10. Assembly 10, as illustrated, includes three primary components: a receptacle 12, a stopcock 14 (or similar article) and a removable cover 15. Stopcock 14 is the article of choice which is to be packaged in assembly 10 and is more clearly illustrated in FIG. 2.

It can be seen that stopcock 14 is a three-way fluid flow device. This stopcock includes three ports, all in fluid communication with each other. Ports 16 and 18 are aligned on opposite ends of a common axis, while the third port 19 is aligned substantially perpendicular to the aforesaid commonly aligned axis. An operable valve 20 can be rotated in different directions so that any two of the three ports are in fluid flow communication with each other at a given time. It is preferred, although not necessary, that port 16 and 19 be formed with screw threads 21 and 22, respectively, so that a syringe or like device can be threaded onto the stopcock for connection.

Figure 3:
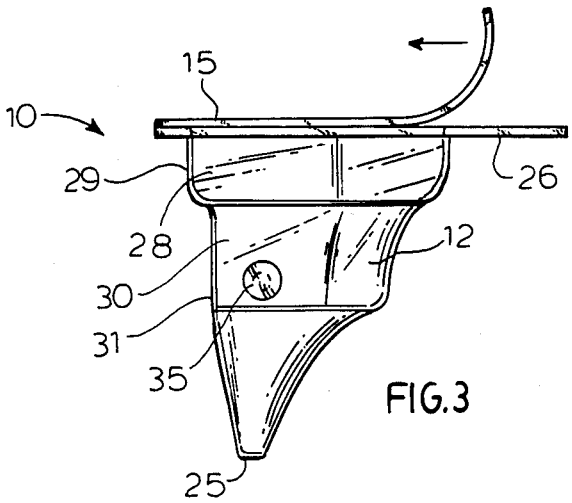
FIG. 3 is a front elevational view of the assembly of FIG. 1.
Figure 4:
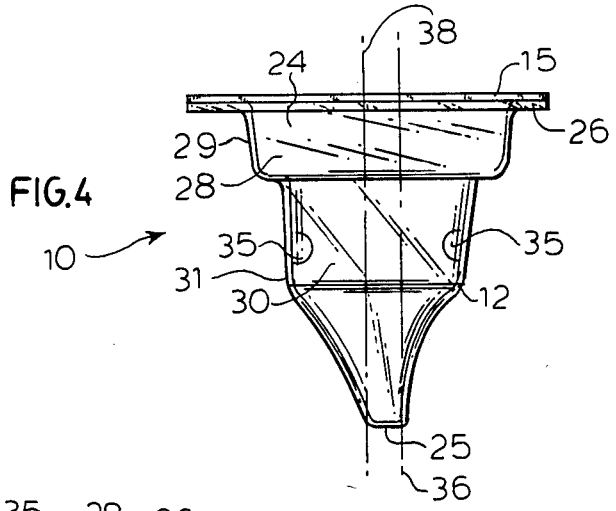
FIG. 4 is a side elevational view of the assembly of FIG. 1.
Figure 5:
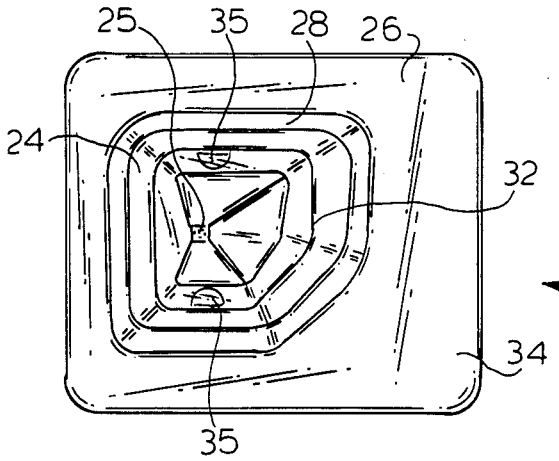
FIG. 5 is a top plan view of a package for sealing an article, such as a stopcock, witht he cover removed, and similar to the package of FIG. 1.

Referring now to FIGS. 3 to 5, package assembly 10 includes a receptacle 12 which is a substantially rigid structure primarily to prevent the contents of the package from being crushed during shipment or storage. Receptacle 12 includes an open end 24 and a closed end 25. Open end 24 is defined by a preferably square-shaped flange 26 surrounding the open end. Open end 24 is normally sealed with a removable cover 15 after the contents are placed in the package. Cover 15 may be bonded to flange 26 by means of adhesives, heat sealing or other like means. However, one edge of cover 15 is usually left unsealed so that it can be gripped to facilitate peeling the cover from the package when the contents are ready to be used. It is preferred that the seal of cover 15 onto the package be sufficient to maintain the contents inside the package in clean, sterile condition. A fiber free cover is also desirable from this standpoint.

Receptacle 12 is formed with a main cavity 28 directly under open end 24. Sidewalls 29 define cavity 28. A smaller cavity or recess 30 extends from main cavity 28 and is defined by sidewalls 31. In the embodiment being described, sidewalls 31 are orthogonally arranged so that they define a substantially square-shaped recess 30. Two of the sidewalls 31 are truncated to form an angular wall 32 connecting the truncated portions. Angular wall 32 is formed in the package so that a greater area can be provided for peeling the cover from the package at corner 34 of flange 26. Two protuberant detents 35 are formed on sidewalls 31, protruding a slight distance into recess 30. Both the structure of recess 30 and detents 35 contribute to form a retention portion for a stopcock and for preventing rotatory movement of the stopcock when placed inside the package.

Sidewalls 31 taper toward each other below recess 30 (as seen in FIGS. 3 and 4) to form closed end portion 25. It is preferred that closed end portion 25 be somewhat flattened so that one of the ports of the stopcock can rest thereon when placed in the package. As seen particularly in FIG. 4, due to the nature of the stopcock or like articles, and for conservation of materials when forming receptacle 12, the axis 36 of closed end 25 is offset from the axis 38 of open end 24. This facilitates insertion of the stopcock in the receptacle and contributes to maintaining the stopcock in position therein during shipment, storage and handling immediately before use. Of course, it is understood that the offset nature of the closed end of the receptacle with respect to the open end is merely preferable and need not be provided as an essential element of the present invention.

While many different materials may be utilized in fabricating the package of the present invention, it is preferred that the receptacle be made of translucent, rigid plastic. Desirably, this plastic should be lightweight, but should resist being crushed under normal handling conditions.

Figure 6:
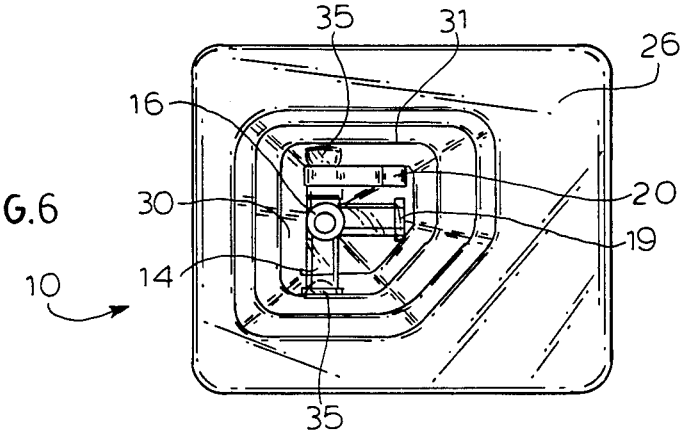
FIG. 6 is a top plan view of the package of FIG. 5 illustrated with the stopcock of FIG. 2 positioned therein.
Figure 7:
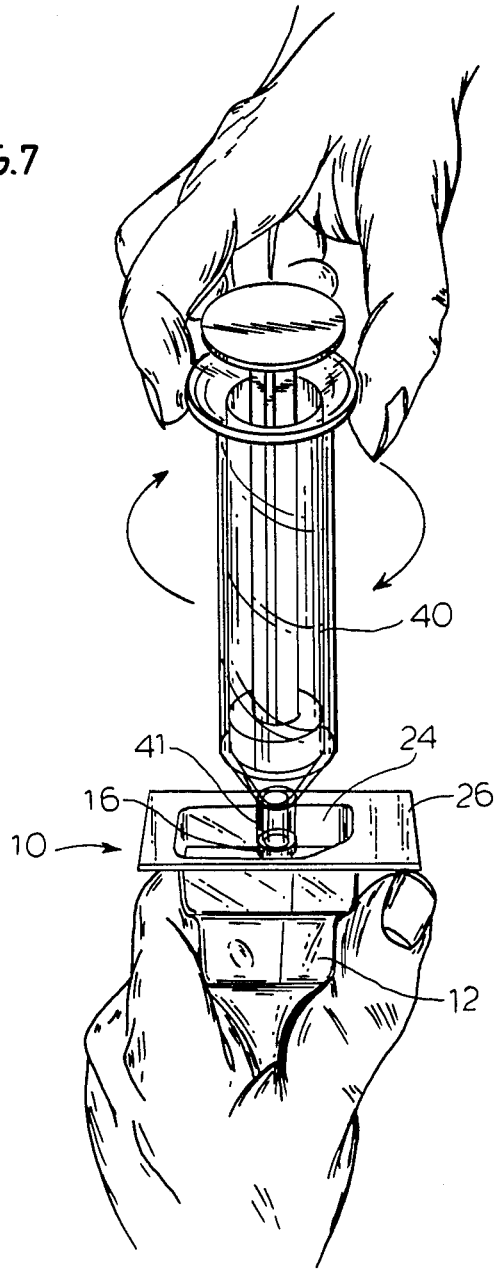
FIG. 7 is a perspective view illustrating the attachment of a syringe to the stopcock while positioned in the package before removal.

Turning now to FIGS. 1 and 6, it can be seen that stopcock 14 is positioned inside receptacle 12 so that one of the commonly aligned ports 18 lies adjacent closed end 25. In this orientation, the other commonly aligned port 16 lies adjacent the open end of the receptacle. The perpendicular port 19 and the operable valve handle 20 lie in the retention portion of the package defined by recess 30. It can be seen, particularly in FIG. 6, that the orthogonal nature of stopcock 14 allows it to be positioned inside recess 30 in a close fitting arrangement. Thus, the orthogonally oriented walls 31 surrounding recess 30 will prevent rotatory movement of stopcock 14 therein. To further facilitate the maintenance of the stopcock in the receptacle, detents 35 contact the end portions of stopcock 14 so that the stopcock has to be snapfit in the receptacle. The appearance of stopcock 14 in FIG. 6 is the view that the user finds when the cover is peeled from the package when access to the stopcock is required. The detents prevent the stopcock from falling out of the receptacle if, for instance, the opened package should be turned over. In order to remove the stopcock from the receptacle, the opened package is held by one of the user's hands while a syringe or like device is connected to the stopcock. This procedure is illustrated in FIG. 7.

Figure 8:
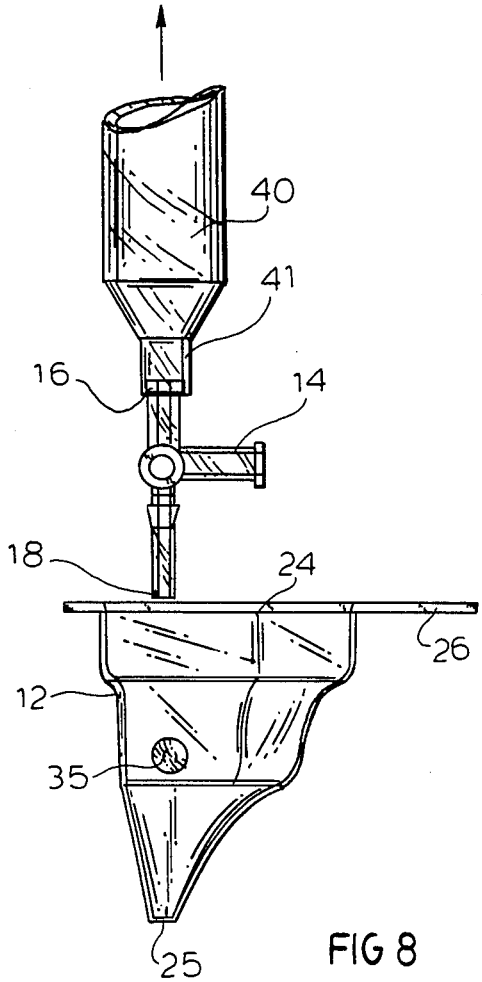
FIG. 8 is a side elevational view illustrating the stopcock connected to the syringe and its removal from the package of the present invention.

It can be seen that syringe 40 includes a female threaded section 41 which is threaded onto port 16 of the stopcock inside receptacle 12. As can be seen in FIG. 7, the user's hands merely touch the outside of the receptacle itself without having to actually touch the clean, sterile stopcock within. Inasmuch as rotatory movement of the stopcock is prevented by virtue of the structure of the present package, syringe 40 can be threaded onto the stopcock port with no difficulty. Once this threaded engagement has been completed, the user merely lifts the stopcock out of the package by pulling upwardly, as illustrated in FIG. 8. The detents inside receptacle 12 readily give way when the upward force is applied to the stopcock when lifting it out of the package. Once the stopcock has been removed, it can be used to control the fluid flow to or from a number of sources in a single procedure.

In those circumstances wherein the stopcock, or other article, is to be used in a sterile field, it can be removed from the package before the syringe is attached. The rigid structure of the receptacle is sufficiently flexible to permit it to be squeezed by the fingers of the user. Upon firmly squeezing the external surface of the receptacle, while directing the open package toward the sterile field, the stopcock or other article therein will pop out of the package without being touched by the fingers of the user. Thereafter, attachment can be made to a syringe or like device.

Thus, the present invention provides a package for holding an article, such as a stopcock, in a relatively stable position during use so that fewer manipulative steps are required when removing this article from the package. The structure of the present invention and the attendant procedure in gaining access to the packaged article minimizes opportunities for contamination of the article when the package is opened.

What is claimed is:

1. A package for sealing a stopcock having at least three ports therein comprising:

a substantially rigid receptacle for receipt of said stopcock having an open end sufficiently large for access of said stopcock into and out of said receptacle, said receptacle defined by at least three orthogonally oriented sidewalls forming a retention portion for said stopcock and for preventing rotatory movement of said stopcock therein, a portion of said sidewalls being tapered toward each other to form a closed end of said receptacle, said tapered closed end adapted to receive one port of said stopcock therein, said open end adapted to be sealed with cover means after a stopcock is placed inside said receptacle.

2. The package of claim 1 which further includes detents on opposed orthogonal walls for maintaining the stopcock in position within said receptacle.

3. The package of claim 1 wherein said closed end is offset from the axis of said open end to facilitate insertion of the stopcock in said receptacle.

4. The package of claim 1 wherein said receptacle is mde of translucent, rigid plastic.

5. A packaged stopcock assembly comprising;

a stopcock having three ports, two of said ports aligned on opposite ends of a common axis, said third port being aligned substantially perpendicular to said axis, said stopcock including an operable valve for selectively controlling flow through said ports; and a package including a substantially rigid receptacle into which said stopcock is positioned, said receptacle having an open end sufficiently large for access of said stopcock into and out of said receptacle, said receptacle having a retention portion adapted to prevent rotatory movement of said stopcock therein, and having a tapered closed end portion, said stopcock oriented in said receptacle with one of said commonly aligned ports positioned in said tapered closed end, said third port positioned in said retention portion of said receptacle, and the other of said commonly aligned ports positioned adjacent said open end, said open end being sealed by removable cover means.

6. The assembly of claim 5 wherein said retention portion of said receptacle is defined by at least three orthogonally oriented sidewalls.

7. The assembly of claim 6 which further includes detents on opposed orthogonal walls engaging said stopcock for maintaining stopcock in position within said receptacle.

8. The assembly of claim 5 wherein said receptacle is made of translucent, rigid plastic.

9. The assembly of claim 5 wherein said receptacle is sufficiently flexible to permit external squeezing thereof against the stopcock contained therein to cause said stopcock to pop out of said receptacle.

* * * * *